US007335062B1

(12) United States Patent
Ju

(10) Patent No.: US 7,335,062 B1
(45) Date of Patent: Feb. 26, 2008

(54) ELECTRIC CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/607,049

(22) Filed: Dec. 1, 2006

(51) Int. Cl.
*H01R 13/648* (2006.01)

(52) U.S. Cl. ..... 439/607; 439/887; 439/541.5; 439/941

(58) Field of Classification Search ..... 439/607, 439/887, 541.5, 941

See application file for complete search history.

(56) References Cited

U.S. PATENT DOCUMENTS 6,503,103 B1 * 1/2003 Cohen et al. ..... 439/608

* cited by examiner

*Primary Examiner*—Javaid H. Nasri
(74) *Attorney, Agent, or Firm*—Troxell Law Office, PLLC

(57) ABSTRACT

An electric connector has an insulating body, a plurality of conductive terminals installed in the insulating body. The conductive terminals have a first set of conductive terminals and a second set of conductive terminals. The first set of conductive terminals are made of different materials from the second set of conductive terminals so as to reduce the impedance between the first set of conductive terminals and the second set of conductive terminals. The electric connector can reduce impedance among conductive terminals so as to increase electric functions, because the different conductive terminals are made of different materials.

7 Claims, 2 Drawing Sheets

ELECTRIC CONNECTOR

BACKGROUND OF THE INVENTION (a) Field of the Invention

The present invention relates to electric connectors, in particular to an electric connector with a novel devise.

(b) Description of the Prior Art

An electric connector of a prior art has an insulating body with a plurality of openings, a plurality of terminal receiving grooves, a plurality of inner shielding casings installed in the openings, a plurality of conductive terminals inserted into the terminal receiving grooves and an outer shielding casing covered on the insulating body. A rear plug serves to prevent from a short circuit caused by self-deformation of the adjacent terminals or stains of dust and dirt. The rear plug serves also to position properly the end of the terminals firmly aiming for an electric circuit. However, because the conductive terminals of the electric connectors of the prior art are usually made of the same materials (usually compound copper), such as compound of phosphorous-copper, and lengths of the conductive terminals are different, the impedance of each conductive terminal is different. Therefore, the different impedances will impede synchronous transfers of electric signals so as to disadvantage to increase the electric functions. It is necessary to have a new style of an electric connector so as to overcome the above-mentioned defects.

SUMMARY OF THE INVENTION

The primary objective of the present invention is to provide an electric connectors by improving a prior art. The electric connector has an insulating body, a plurality of conductive terminals installed in the insulating body. The conductive terminals have a first set of conductive terminals and a second set of conductive terminals. The first set of conductive terminals are made of different materials of the second set of conductive terminals so as to reduce the impedance between the first set of conductive terminals and the second set of conductive terminals. Comparing to prior arts, the present invention can reduce impedance among conductive terminals so as to increase electric functions, because the different conductive terminals are made of different materials.

DETAILED DESCRIPTION OF THE PREFERRED EMBODIMENTS

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
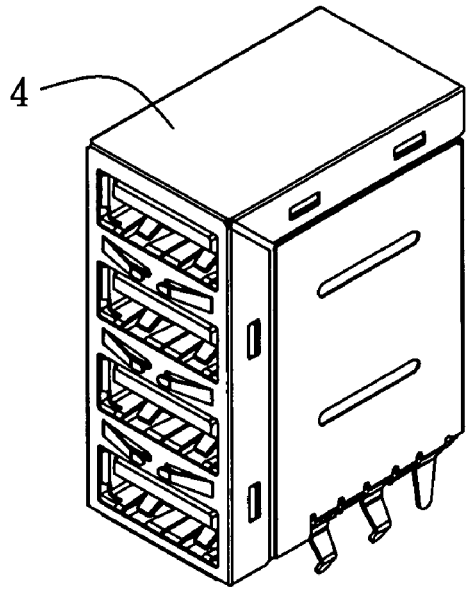
FIG. 1 is a perspective assembled view of the present invention.
Figure 2:
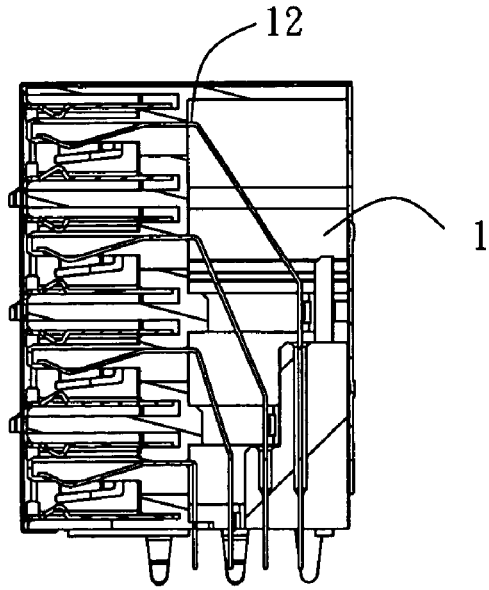
FIG. 2 is a cross-sectional view of the FIG. 1.
Figure 3:
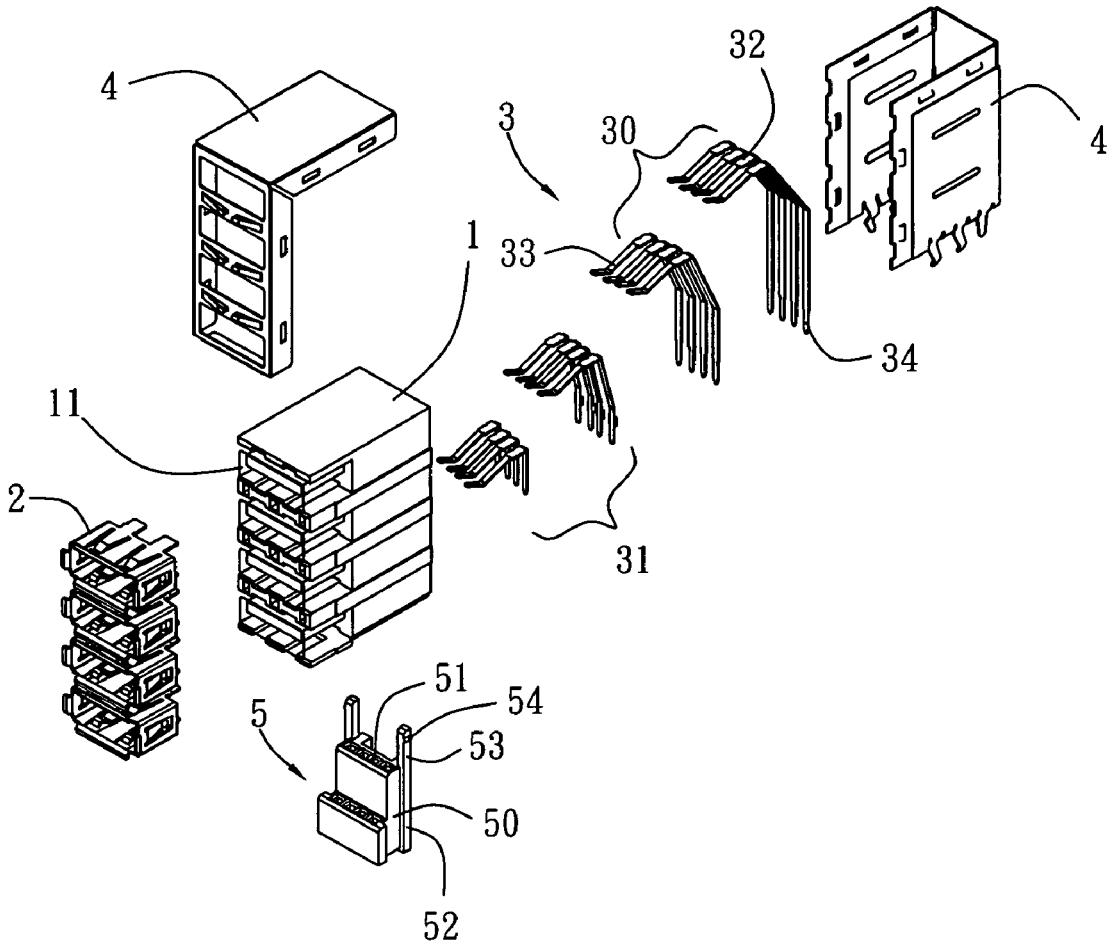
FIG. 3 is a perspective exploded view of the present invention.

Referring to FIGS. 1 to 3, the electric connector of the present invention has a plurality of openings 11, an insulating body 1 with a plurality of terminal receiving grooves 12, a plurality of inner shielding casing 2 installed in the openings 11, a plurality of conductive terminals 3 installed into the terminal receiving grooves 12, a outer shielding casing 4 for covering the insulating body 1, and a rear plug 5 installed in the rear of insulating body 1.

The conductive terminal 3 includes a first set of conductive terminals 30 and a second set of conductive terminals 31. The first set of conductive terminals 30 has a higher conductive electric conductivity than the second set of conductive terminals 31, because the first set of conductive terminals 30 are made of different raw materials from the second set of conductive terminals 31. The first set of conductive terminals 30 are made of compound of nickel-copper materials. The second set of conductive terminals 31 are made of compound of phosphorous-copper materials. Both the first set of conductive terminals 30 and the second set of conductive terminals 31 have high conductive electric conductivity and the same shape. The conductive terminal 3 has a retaining portion 32, a contact portion 33 for connecting to any other exterior electric unit, and a conductive portion 34 for conducting to a circuit board (not shown). The first set of conductive terminals 30 is longer than the second set of conductive terminals 31. However, because the conductive electric conductivity of the first set of conductive terminals 30 is higher than the second set of conductive terminals 31, both the impedances of the first set of conductive terminals 30 and the second set of conductive terminals 31 are almost the same. Basically, the synchronous transfer of electric signals of the first set of conductive terminals 30 and the second set of conductive terminals 31 can be achieved so as to increase helpfully the electric functions. Besides, the shapes of the contact portion 33 of the conductive terminal 3 are the same.

The rear plug 5 is made of plastics. The rear plug 5 has a main body 50. The main body 50 has a plurality of holes 51, strips 52, arms 53, protrusions 54. The hole 51 sets upright thoroughly so as to be corresponding and receiving to the rear of the conductive terminal 3. The two strips 52 are formed by extending outwards from the two sides of the main body 50. Besides, the two arms 53 is formed by extending upwards from the two strips 52. The protrusion 54 is formed by extending out the two sides of ends of arms 53. The two pairs of raisers (not shown) are formed on the rear portion of the insulating body 1 close to the surface of the insulating body 1 so as to prevent from slipping outwards the rear plug 5 after being assembled thereof. The two inner sides of the insulating body 1 have respectively two pairs of level slots (not shown) so as to be corresponding to the protrusion 54 of the rear plug 5. When being assembled, the rear plug 5 is inserted by using of the two arms 53 along the raisers. When being inserted to a proper position, the raiser buckles into the slop so as to retain the both the insulating body 1 and the rear plug 5. The conductive terminal 3 is fixed to the insulating body 1. Then the inner shielding casing 2 is installed to the opening 11. Finally, the outer shielding casing 4 is installed on the insulating body 1.

The electric connector can reduce the impedances among the conductive terminals so as to increase the electric functions thereof, because of differences in the materials of the conductive terminals.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electric connector comprising:

an insulating body; a plurality of conductive terminals installed in the insulating body;

the conductive terminals having a first set of conductive terminals and a second set of conductive terminals;

the first set of conductive terminals being made of different material than the second set of conductive terminals; the electric conductivity of the first set of conductive terminals being higher than the second set of conductive terminals; and the first set of conductive terminals being longer than the second set of conductive terminals so as to reduce impedance between the first set of conductive terminals and the second set of conductive terminals.

2. The electric connector as claimed in claim 1, wherein the first set of conductive terminals are made of raw materials of nickel-copper.

3. The electric connector as claimed in claim 1, wherein the second set of conductive terminals are made of raw material of phosphorous-copper.

4. the electric connector as claimed in claim 1, wherein a rear plug is installed behind a rear side of the insulating body; and the rear plug has a main body and two arms extending from the main body.

5. The electric connector as claimed in claim 1, wherein the insulating body has a plurality of openings; a plurality of inner shielding casings are installed in the openings; and a outer shielding casing covers on the insulating body.

6. The electric connector as claimed in claim 1, wherein a shape of a contact portion of the first and second set of conductive terminals are the same.

7. The electric connector as claimed in claim 1, wherein each conductive terminals have a retaining portion; a contact portion serves to connect an exterior electric unit; a connecting portion serves to connect a circuit board.

* * * * *